US012798733B2

(12) United States Patent
Liu et al.

(10) Patent No.: US 12,798,733 B2
(45) Date of Patent: Nov. 17, 2026

(54) PROCESSING METHOD FOR REALIZING CONVENIENT WATERTIGHT COMPARTMENTATION BASED ON CONTAINER SHIP COMBINED SUPPORTS WATER BLOCKING COVER

(71) Applicant: Zhejiang International Maritime College, Zhoushan (CN)

(72) Inventors: Zailing Liu, Zhoushan (CN); Yishan Li, Zhoushan (CN)

( * ) Notice: Subject to any disclaimer, the term of this patent is extended or adjusted under 35 U.S.C. 154(b) by 365 days.

(21) Appl. No.: 18/469,508

(22) Filed: Sep. 18, 2023

(65) Prior Publication Data

US 2024/0270355 A1 Aug. 15, 2024

(30) Foreign Application Priority Data

Feb. 15, 2023 (CN) ..... 202310116062.8

(51) Int. Cl.
*B63B 73/50* (2020.01)

(52) U.S. Cl.
CPC ..... *B63B 73/50* (2020.01)

(58) Field of Classification Search
CPC ..... B63B 73/50
See application file for complete search history.

(56) References Cited

U.S. PATENT DOCUMENTS 3,447,503 A * 6/1969 Myers ..... B63B 73/30 114/65 R
2023/0391434 A1* 12/2023 Paturu ..... B63C 9/22
2025/0256828 A1* 8/2025 Sankrithi ..... B60V 3/06

FOREIGN PATENT DOCUMENTS

BR 9102306 A * 1/1992 ..... B63B 3/22
GB 2088293 A * 6/1982 ..... B63B 3/04
GB 2088788 B * 3/1984 ..... B63B 73/20

* cited by examiner

*Primary Examiner* — Marc Q Jimenez
*Assistant Examiner* — Jovon E Hayes

(57) ABSTRACT

The invention discloses a processing method for realizing convenient watertight compartmentation based on container ship combined support water blocking cover, comprising following steps: 1) completing manufacturing of the frame; 2) fixing the frame; 3) installing the water blocking cover; 4) the lower end of water blocking cover extends downwards to the half ship outer bottom plating and is fixed; 5) the upper end of the water blocking cover extends upwards and is fixed; 6) after the water blocking cover is installed and fixed, liquid level meter is arranged inside the half ship and record current liquid level to detect liquid level change inside the half ship in real time. Two floating ends of the half ship are unclosed openings, which adopt detachable supports as support with water blocking cover laid on the outside thereof, magnet and the rope used for fixing openings of the half ship for watertight compartmentation.

7 Claims, 2 Drawing Sheets

PROCESSING METHOD FOR REALIZING CONVENIENT WATERTIGHT COMPARTMENTATION BASED ON CONTAINER SHIP COMBINED SUPPORTS WATER BLOCKING COVER

1. TECHNICAL FIELD

The invention specifically relates to a processing method for realizing convenient watertight compartmentation based on container ship combined supports water blocking cover.

2. BACKGROUND ART

In the construction of container ship, the construction cycle of the dock is an important manifestation of a shipyard shipbuilding capacity, which is also an important indicator to measure the ship delivery and realize economic benefit; the most direct way to shorten the ship construction cycle is to shorten the dock cycle and dock construction usually adopts approach of one ship+half ship to construct, which also faces that after the first ship in the dock floating out of the dock, the half ship also need floating and forward shift operation.

In the process of building ship in dock, two floating ends of the half ship are usually unclosed openings; for the unclosed openings, in order to prevent seawater in the dock to enter the interior of the half ship, the openings are needed sealing with temporary steel plate, as shown in FIG. 1, the head and tail end of the half ship need to be welded with the steel plate, and damage caused to the paint of half ship in the welding process will increase the workload of the welding and the construction cycle is also relative long; at the same time, the grinding workload for detaching buckles of the sealing steel plate also increases the construction time in the dock, which cannot reasonably utilize the resources of the dock.

3. SUMMARY OF THE INVENTION

Aimed at the shortcomings in prior art, the purpose of the invention is to provide a processing method for realizing convenient watertight compartmentation based on container ship combined supports water blocking cover.

In order to realize said purpose, the invention provides the following technical scheme:

a processing method for realizing convenient watertight compartmentation based on container ship combined supports water blocking cover comprises the following steps:

1) assembly a plurality of detachable supports according to the section line type of the half ship, completing the manufacturing of the frame;
2) fixing the frame to the openings at the front and rear ends of the half ship according to the openings' transverse line type of the half ship;
3) installing the water blocking cover, which is arranged covering the whole frame and is fixed and connected with the frame by the strong magnet in the water blocking cover;
4) the lower end of the water blocking cover extends downwards to the half ship outer bottom plating and is fixed with the outer bottom plating via the strong magnet; a plurality of eye thimbles at the edge of the water blocking cover and the strong magnet fixed on the outer plating are connected and fixed through ropes;
5) the upper end of the water blocking cover extends upwards, and a plurality of eye thimbles at the edge of the water blocking cover and openings of the half ship structure are fixed via nylon ropes and strong magnets;
6) after the water blocking cover is installed and fixed, a liquid level meter is arranged inside the half ship and record the current liquid level, so as to detect the liquid level change inside the half ship in real time through the liquid level meter.

Said detachable support is formed by splicing longitudinal flat steel, transverse flat steel and oblique flat steel.

The maximum height of the frame is larger than the designed half ship draft, and the maximum height-half ship draft is larger than 500 mm.

Said water blocking cover includes lining made of 5 mm rubber plate and 2.5 mm waterproof cloth is applied at two sides of said lining, in said water blocking cover is equipped with a plurality of strong magnet and the horizontal interval between each strong magnet is 250 mm, and vertical interval is 500 mm.

The upper end of the water blocking cover is connected with the frame through turnbuckle and hook.

The lower end of the water blocking cover extends to the outer bottom plating of the half ship, and the extending length is greater than or equal to 750 mm.

The upper end of the water blocking cover extends upward, and the extending length is greater than or equal to 100 mm.

The invention has the following advantageous effects: two floating ends of the half ship are unclosed openings, which adopt detachable supports as support with water blocking cover laid on the outside thereof, magnet and the rope used for fixing the openings of the half ship for watertight compartmentation, so that water in the dock can't flow into the ship; it can be applied to the half ship floating of a plurality of container ships, which can quickly finish blocking, avoiding welding of hull and steel plating, reducing workload of dock, and improving watertight compartmentation efficiency.

4. BRIEF DESCRIPTION OF ACCOMPANY DRAWINGS

5. SPECIFIC EMBODIMENT OF THE INVENTION

Figure 1:
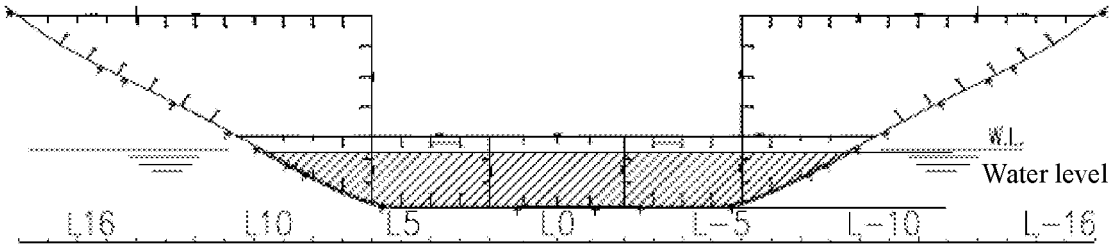
FIG. 1 is the traditional blocking schematic diagram.
Figure 2:
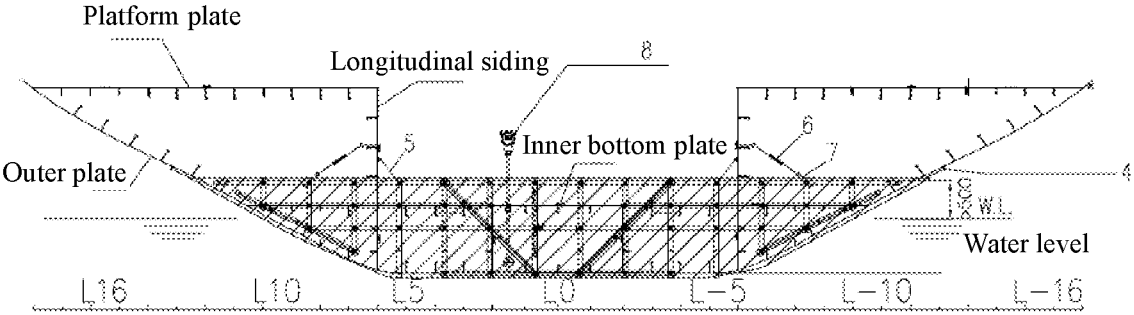
FIG. 2 is the schematic diagram of the invention.
Figure 3:
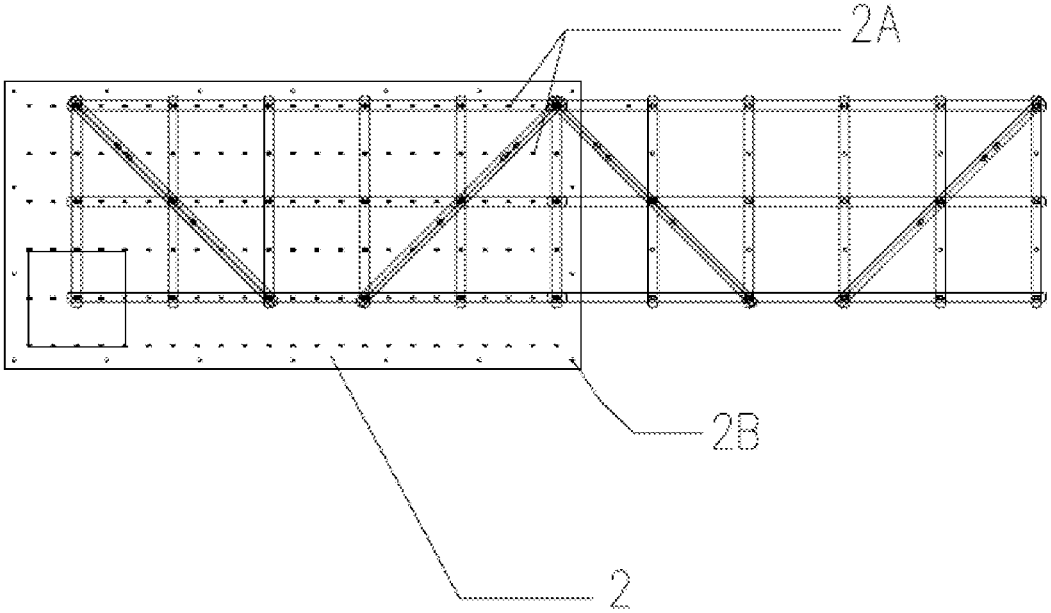
FIG. 3 is the structural diagram of the frame in the invention.
Figure 4:
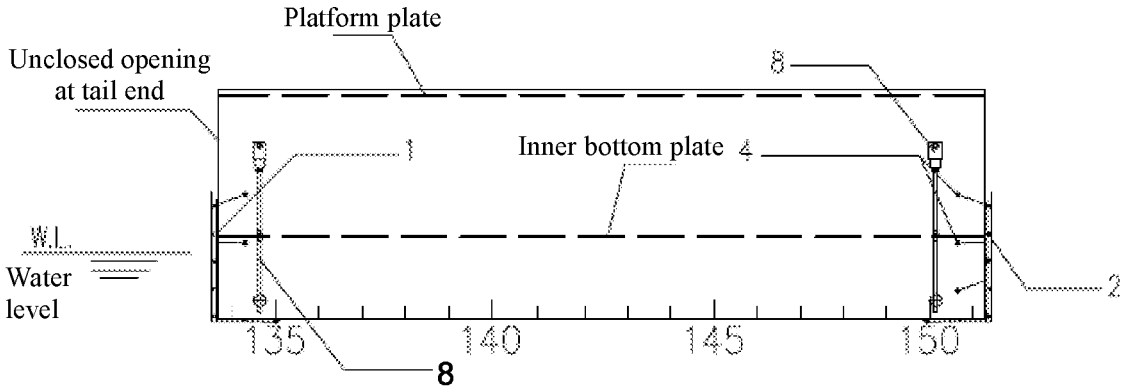
FIG. 4 is the sectional view applied to the half ship of the invention.

The technical scheme of the invention is further described clearly and in detail hereinafter with reference to the drawings. Obviously, only partial embodiments of the invention are shown and the actual structure is not limited thereto. All other embodiments, which can be obtained by those skilled in the art without making any creative effort based on the embodiments in the invention, shall all fall within the protective scope of the invention.

It should be noted that all directional indications (such as up, down, left, right, forward, back . . . ) in the embodiments of the invention are only used to explain the relative positional relationship, movement, etc., between the various components in a particular attitude (as shown in the accompanying drawings), and that the directional indications are correspondingly changed in the event of a change in that particular attitude.

As shown in drawings, the invention discloses a processing method for realizing convenient watertight compartmentation based on container ship combined supports water blocking cover comprises the following steps:

1) assembly a plurality of detachable supports according to the section line type of the half ship, completing the manufacturing of the frame; mounting a plurality of detachable supports 1 at the head and tail ends of the half ship in the dock, which can be fixed together through bolts and nuts; in order to fit to different section lines type of ships, each flat steel that constitutes the support is designed with different length, including longitudinal flat steel, transverse flat steel and oblique flat steel, wherein the oblique flat steel can prevent the support from deformation and bear the hydraulic pressure in the dock; detachable supports 1 can be combined with other detachable supports with different standards, which means a plurality of standard frames can be adopted for assembly and form arbitrary openings and sections when the openings of the half ship is relative large, the connecting approach of which is similar with bolted connection of standard frames, the connection is convenient and universality is high.
2) fixing the frame to the openings at the front and rear ends of the half ship according to the openings' transverse line type of the half ship, which usually adopt a plurality of flat steel with different length for supporting, and adopt bolts and nuts for fixing;
3) installing the water blocking cover, which is arranged covering the whole frame and is fixed and connected with the frame by the strong magnet in the water blocking cover; installing the water blocking cover (the lining thereof is made of 5 mm rubber plate and 2.5 mm waterproof cloth is applied at two sides of said lining), which is fixed and connected with the detachable supports 1 via the strong magnet 2A inside the water blocking cover; the size of the magnet is 40×20×3, the horizontal interval between each strong magnet is 250 mm, and vertical interval is 500 mm. The minimal tensile force of each strong magnet 2A is 10 kg, and the tensile force of each square meter is 150 kg;
4) the lower end of the water blocking cover extends downwards to the half ship outer bottom plating with extending length of 750 m in normal case, and is fixed with the outer bottom plating via the strong magnet 2A; a plurality of eye thimbles at the edge of the water blocking cover and the D60 strong magnet 4 fixed on the outer plating are connected and fixed through ropes; the purpose of using strong magnet and rope to fix the water blocking cover 2 is to avoid damage to the paint through welding of the ship outer plating;
5) the upper end of the water blocking cover 2 extends upwards with extending length of 100 m in normal case, and a plurality of eye thimbles at the edge of the water blocking cover and openings of the half ship structure are fixed via nylon ropes 5 and D60 strong magnets 4; additionally, the turnbuckle 6 and hook 7 are adopted to connect the detachable supports. The turnbuckle 6 can tighten the rope for fixing.
6) after the water blocking cover is installed and fixed, a liquid level meter is arranged inside the half ship and record the current liquid level, so as to detect the liquid level change inside the half ship in real time through the liquid level meter. The liquid level meter 8 timely records whether water enters the ship and monitor the water inflow, which is convenient for staff on shore or on board to understand the internal water level changes in time, read the level meter to detect the depth of water, and prevent water infiltration into the ship; when the float liquid level gauge works, ring-shaped magnetic float is adopted to rise or fall along with the liquid level, so that the reed switch within the sensor pulls in, at this time the liquid level will be converted into corresponding resistance output signal with the output standard of 4-20MA signal with the HART protocol communication.

Considering the connection structure between the detachable supports and the ship or too much magnetic force for magnetic suction, and is not easy to take down, D60 strong magnet related magnetic force selected should not be greater than 50 kgf.

The embodiments shall not be regarded as a limitation of the invention, but any improvement based on the spirit of the invention shall be within the protection scope of the invention.

The invention claimed is:

1. A construction method for realizing watertight sealing of a half-hull based on container ship combined brackets water blocking cover, comprises the following steps:

1) assembling a plurality of detachable brackets to form a frame according to section lines of the half-hull;
2) fixing the frame to openings at front and rear ends of the half-hull according to the openings' transverse lines of the half-hull;
3) installing the water blocking cover, wherein the water blocking cover is arranged covering the entire frame and is fixed and connected with the frame by permanent magnets in the water blocking cover;
4) a lower end of the water blocking cover extends downwards to an outer bottom plating of the half-hull and is fixed with the outer bottom plating via the permanent magnets; a plurality of eye thimbles at edge of the water blocking cover and the permanent magnets fixed on the outer bottom plating are connected and fixed through ropes;
5) an upper end of the water blocking cover extends upwards, the plurality of eye thimbles at the edge of the water blocking cover and openings of the half-hull are fixed via nylon ropes and the permanent magnets;
6) after the water blocking cover is installed and fixed, a liquid level meter is arranged inside the half-hull and record an initial liquid level, so as to detect the liquid level change inside the half-hull in real time through the liquid level meter.

2. The construction method of claim 1, wherein said detachable brackets are formed by splicing longitudinal flat steel, transverse flat steel and oblique flat steel.

3. The construction method of claim 1, wherein a maximum height of the frame is larger than a designed draft height of a half-hull, and a difference between the maximum height of the frame and the designed draft height of the half-hull is larger than 500 mm.

4. The construction method of claim 1, wherein said water blocking cover includes a lining made of 5 mm-thick rubber plate, 2.5 mm-thick waterproof cloth is applied at two sides of said lining, in said water blocking cover is equipped with a plurality of the permanent magnets and a horizontal interval between adjacent permanent magnets is 250 mm, and a vertical interval between adjacent permanent magnets is 500 mm.

5. The construction method of claim 1, wherein the upper end of the water blocking cover is connected with the frame through turnbuckle and hook.

6. The construction method of claim 1, wherein the lower end of the water blocking cover extends to the outer bottom plating of the half-hull, and an extending length is no less than 750 mm.

7. The construction method of claim 1, wherein the upper end of the water blocking cover extends upward, and an extending length is no less than 100 mm.

* * * * *